US010815753B2

(12) United States Patent
Greci et al.

(10) Patent No.: US 10,815,753 B2
(45) Date of Patent: Oct. 27, 2020

(54) OPERATION OF ELECTRONIC INFLOW CONTROL DEVICE WITHOUT ELECTRICAL CONNECTION

(71) Applicant: Halliburton Energy Services, Inc., Houston, TX (US)

(72) Inventors: Stephen Michael Greci, Little Elm, TX (US); Thomas J. Frosell, Irving, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 93 days.

(21) Appl. No.: 16/074,716

(22) PCT Filed: Apr. 7, 2016

(86) PCT No.: PCT/US2016/026463
§ 371 (c)(1),
(2) Date: Aug. 1, 2018

(87) PCT Pub. No.: WO2017/176276
PCT Pub. Date: Oct. 12, 2017

(65) Prior Publication Data

US 2019/0055813 A1 Feb. 21, 2019

(51) Int. Cl.
*E21B 34/06* (2006.01)
*E21B 43/12* (2006.01)
(Continued)

(52) U.S. Cl.
CPC ..... *E21B 34/066* (2013.01); *E21B 41/0085* (2013.01); *E21B 43/08* (2013.01); *E21B 43/12* (2013.01); *E21B 47/06* (2013.01)

(58) Field of Classification Search
CPC ..... E21B 34/066
(Continued)

(56) References Cited

U.S. PATENT DOCUMENTS 8,198,752 B2 6/2012 Fenton et al.
8,235,127 B2 8/2012 Patel et al.
(Continued)

FOREIGN PATENT DOCUMENTS

WO 0045031 A1 8/2000

OTHER PUBLICATIONS

Patent Cooperation Treaty, International Search Report and Written Opinion, PCT Appln. No. PCT/US2016/026463, dated Dec. 27, 2016.

*Primary Examiner* — Taras P Bemko
(74) *Attorney, Agent, or Firm* — McGuireWoods, LLP

(57) ABSTRACT

Included are systems, apparatuses, and methods for operation of an electronic inflow control device without electrical connections. An example of a well system comprises an electric control line and an electronic inflow control device. The electric control line comprises at least one primary winding. The electronic inflow control device comprises a secondary winding inductively coupled to the primary winding; a flow regulator in fluidic communication with an inlet of the electronic inflow control device and adjustable to provide a flow resistance to a fluid flowing through the electronic inflow control device and a controller configured to actuate the flow regulator to change the flow resistance through the electronic inflow control device.

19 Claims, 4 Drawing Sheets

(51) Int. Cl.
*E21B 41/00* (2006.01)
*E21B 43/08* (2006.01)
*E21B 47/06* (2012.01)

(58) Field of Classification Search
USPC ..... 166/373
See application file for complete search history.

(56) References Cited

U.S. PATENT DOCUMENTS

| | | | | |
|---|---|---|---|---|
| 8,334,786 | B2 | 12/2012 | Bowles et al. | |
| 2001/0035288 | A1* | 11/2001 | Brockman | E21B 47/122 166/65.1 |
| 2002/0171560 | A1* | 11/2002 | Ciglenec | E21B 7/061 340/853.1 |
| 2008/0314590 | A1 | 12/2008 | Patel | |
| 2009/0101341 | A1 | 4/2009 | Willauer | |
| 2013/0222148 | A1 | 8/2013 | Gano et al. | |
| 2013/0343918 | A1* | 12/2013 | Fripp | F04B 17/042 417/53 |
| 2014/0015449 | A1 | 1/2014 | Biester et al. | |
| 2015/0009039 | A1* | 1/2015 | Tinnen | H04B 11/00 340/850 |
| 2016/0237782 | A1* | 8/2016 | Carrejo | E21B 43/12 |
| 2016/0319634 | A1* | 11/2016 | Gonzalez | E21B 43/12 |

* cited by examiner

OPERATION OF ELECTRONIC INFLOW CONTROL DEVICE WITHOUT ELECTRICAL CONNECTION

TECHNICAL FIELD

The present disclosure relates to downhole tools for use in a wellbore environment and more particularly to adjusting flow resistance in an electronic inflow control device without an electrical connection to the electronic inflow control device.

BACKGROUND

After a wellbore has been formed, various downhole tools may be inserted into the wellbore to extract the natural resources such as hydrocarbons or water from the wellbore, to inject fluids into the wellbore, and/or to maintain the wellbore. At various times during production, injection, and/or maintenance operations it may be necessary to regulate fluid flow into or out of various portions of the wellbore or various portions of the downhole tools used in the wellbore.

An inflow control device may be used to regulate unequal inflow along the length of a well path. If unregulated, water or gas coning may occur at areas of high drawdown pressure, for example proximate the heel of a horizontal wellbore. Inflow control devices placed along the length of the completion may be used to regulate the unequal pressure.

Some examples of inflow control devices may also be used to restrict the production of water by regulating the inflow of water into the completion and consequently improve recovery and extend the life of the well operation. These inflow control devices may be electronic inflow control devices that comprise electronics and moving parts used to regulate the inflow of water through the inflow control device and the completion. Electronic inflow control devices may be powered by generators using turbines that are spun by the fluid flowing through the electronic inflow control device. Problems may arise with these electronic inflow control devices as they cannot be operated if there is no fluid flowing through the electronic inflow control device. Alternatively, an electronic inflow control device may be powered via an electrical control line run from the surface. Completions typically require a multitude of inflow control devices spaced apart the length of the completion in order to provide the fine granular control needed to produce a flow or pressure profile across the length of the completion. Connecting multiple electronic inflow control devices to an electrical control line is costly and inefficient. Further, there is a limit to the amount of cuts and splices which may be made to an electrical control line which may limit the amount of electronic inflow control devices which may be used in a well operation.

BRIEF DESCRIPTION OF THE DRAWINGS

Illustrative examples of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different examples may be implemented.

DETAILED DESCRIPTION

The present disclosure relates to downhole tools for use in a wellbore environment and more particularly to adjusting flow resistance in an electronic inflow control device without an electrical connection to the electronic inflow control device.

The downhole assembly may include an electronic inflow control device to regulate the flow of fluids between the wellbore and the downhole assembly. A flow regulator of the electronic inflow control device may be actuated to increase or decrease the rate of fluid flow through the electronic inflow control device in response to a signal received by the electronic inflow control device from a signaling device displaced from the electronic inflow control device. For example, the signaling device may be positioned at a well site, a location within the wellbore different from the location of the electronic inflow control device, or a location within a lateral wellbore. Embodiments of the present disclosure and its advantages may be understood by referring to FIGS. 1 through 5, where like numbers are used to indicate like and corresponding parts.

Figure 1:
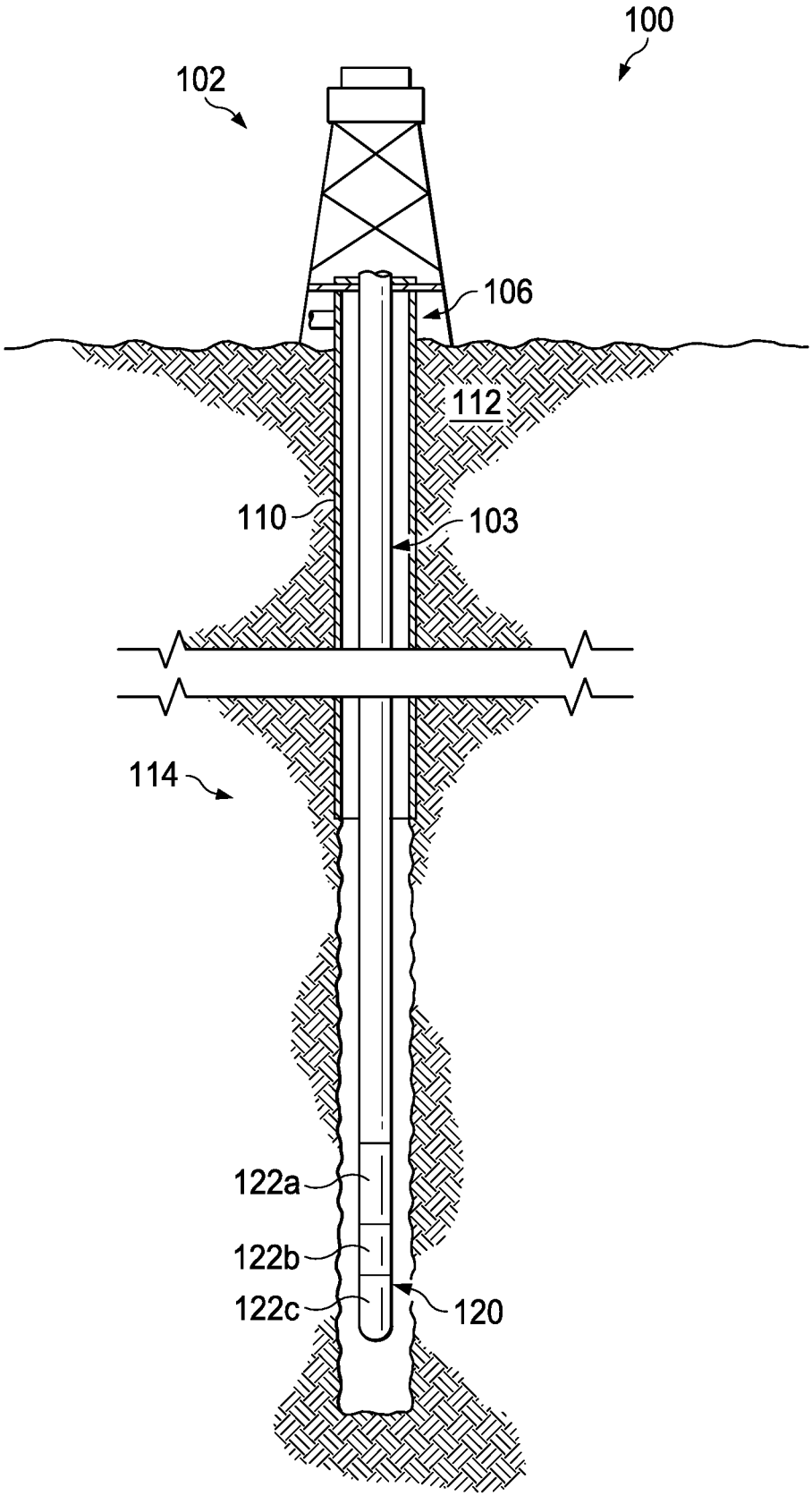
FIG. 1 is an elevation view of a well system.

FIG. 1 is an elevation view of a well system. Well system 100 may include well surface or well site 106. Various types of equipment such as a rotary table, drilling fluid or production fluid pumps, drilling fluid tanks (not expressly shown), and other drilling or production equipment may be located at well surface or well site 106. For example, well site 106 may include drilling rig 102 that may have various characteristics and features associated with a land drilling rig. However, downhole drilling tools incorporating teachings of the present disclosure may be satisfactorily used with drilling equipment located on offshore platforms, drill ships, semi-submersibles and drilling barges (not expressly shown).

Well system 100 may also include production string 103, which may be used to produce hydrocarbons such as oil and gas and other natural resources such as water from formation 112 via wellbore 114. Production string 103 may also be used to inject hydrocarbons such as oil and gas and other natural resources such as water into formation 112 via wellbore 114. As shown in FIG. 1, wellbore 114 is substantially vertical (e.g., substantially perpendicular to the surface). Although not illustrated in FIG. 1, portions of wellbore 114 may be substantially horizontal (e.g., substantially parallel to the surface), or at an angle between vertical and horizontal. Casing string 110 may be placed in wellbore 114 and held in place by cement, which may be injected between casing string 110 and the sidewalls of wellbore 114. Casing string 110 may provide radial support to wellbore 114 and may seal against unwanted communication of fluids between wellbore 114 and surrounding formation 112. Casing string 110 may extend from well surface 106 to a selected downhole location within wellbore 114. Portions of wellbore 114 that do not include casing string 110 may be referred to as open hole.

The terms uphole and downhole may be used to refer to the location of various components relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Well system 100 may also include downhole assembly 120 coupled to production string 103. Downhole assembly 120 may be used to perform operations relating to completion of wellbore 114, production of hydrocarbons and other natural resources from formation 112 via wellbore 114, injection of hydrocarbons and other natural resources into formation 112 via wellbore 114, and/or maintenance of wellbore 114. Downhole assembly 120 may be located at the end of wellbore 114 or at a point uphole from the end of wellbore 114. Downhole assembly 120 may be formed from a wide variety of components configured to perform these operations. For example, components 122*a*, 122*b* and 122*c* of downhole assembly 120 may include, but are not limited to, screens, electronic inflow control devices, nonelectronic inflow control devices, slotted tubing, packers, valves, sensors, and actuators. The number and types of components 122 included in downhole assembly 120 may depend on the type of wellbore, the operations being performed in the wellbore, and anticipated wellbore conditions.

Figure 2:
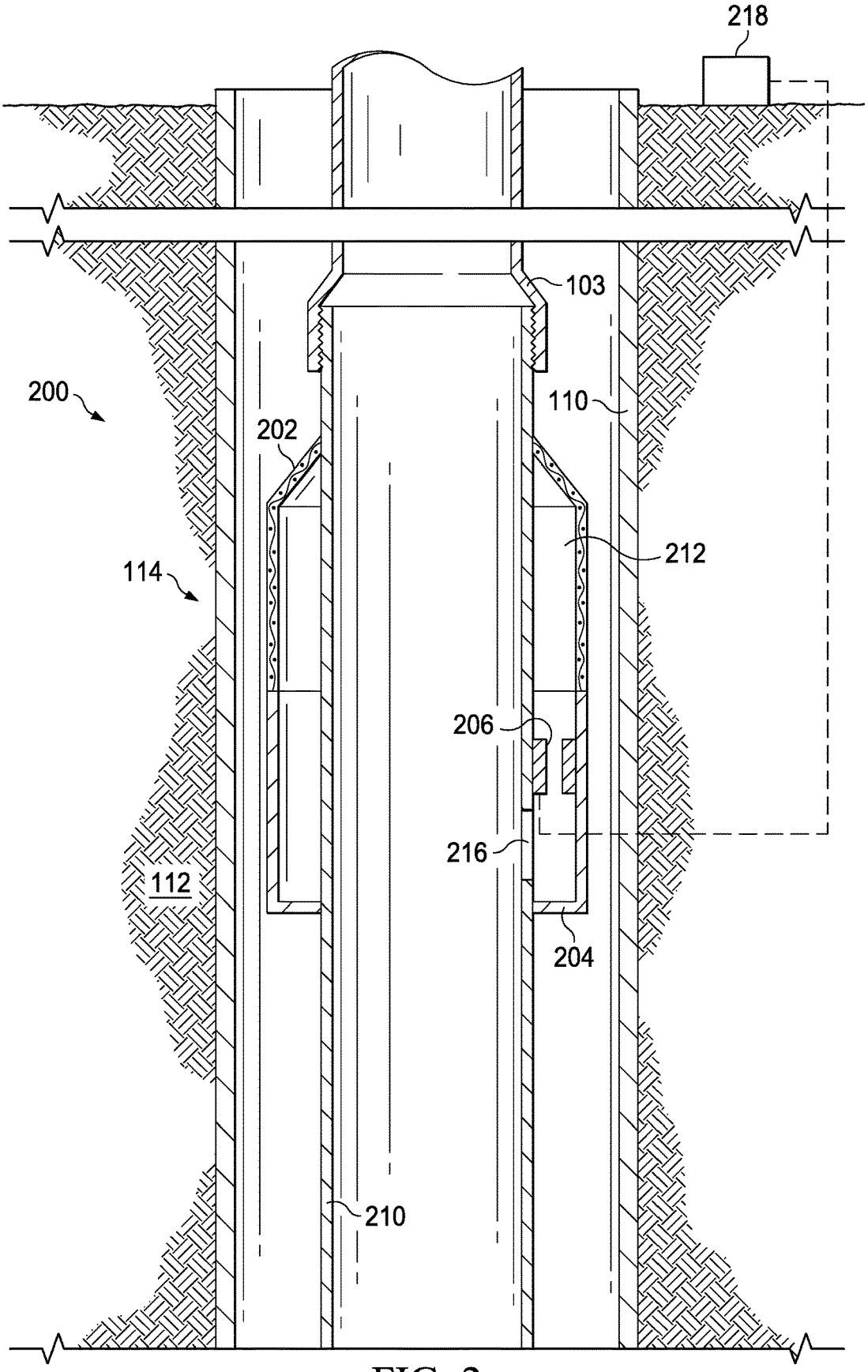
FIG. 2 is a cross-sectional view of a downhole assembly including an electronic inflow control device.

Fluids may be extracted from or injected into wellbore 114 via downhole assembly 120 and production string 103. For example, production fluids, including hydrocarbons, water, sediment, and other materials or substances found in formation 112 may flow from formation 112 into wellbore 114 through the sidewalls of open hole portions of wellbore 114. The production fluids may circulate in wellbore 114 before being extracted from wellbore 114 via downhole assembly 120 and production string 103. Additionally, injection fluids, including hydrocarbons, water, and other materials or substances, may be injected into wellbore 114 and formation 112 via production string 103 and downhole assembly 120. Downhole assembly 120 may include a screen (e.g., screen 202 as illustrated in FIG. 2) to filter sediment from fluids flowing between wellbore 114 and downhole assembly 120. Downhole assembly 120 may also include an electronic inflow control device to regulate the flow of fluids between wellbore 114 and downhole assembly 120. The flow resistance provided by the electronic inflow control device may be adjustable in order to increase or decrease the rate of fluid flow through the electronic inflow control device. Downhole assembly 120 may be in communication with a signaling device (e.g., signaling device 218 as illustrated in FIG. 2), such as a telemetry system, that is displaced from downhole assembly 120 and that signals downhole assembly 120 or the electronic inflow control device to increase or decrease the flow resistance provided by the electronic inflow control device. For example, the signaling device may be located at well site 106, within wellbore 114 at a location different from the location of downhole assembly 120, or within a lateral wellbore.

FIG. 2 is a cross-sectional view of a downhole assembly including an electronic inflow control device 206. Production fluids circulating in wellbore 114 may flow through downhole assembly 200 into production string 103. Similarly, injection fluids circulating in production string 103 may flow through downhole assembly 200 into wellbore 114. Downhole assembly 200 may be located downhole from production string 103 and may be coupled to production string 103 via tubing 210. Downhole assembly 200 may be coupled to production string 103 by a threaded joint. Alternatively, a different coupling mechanism may be employed. The coupling of downhole assembly 200 and production string 103 may provide a fluid and pressure tight seal.

Downhole assembly 200 may include screen 202 and shroud 204. Both screen 202 and shroud 204 may be coupled to and disposed around the circumference of tubing 210 such that screen annulus 212 is formed between the inner surfaces of screen 202 and shroud 204 and the outer surface of tubing 210. Screen 202 may be configured to filter sediment from fluids as they flow through screen 202. Screen 202 may include, but is not limited to, a sand screen, a gravel filter, a mesh, or slotted tubing.

Downhole assembly 200 may also include electronic inflow control device 206 disposed within screen annulus 212 between shroud 204 and tubing 210. Electronic inflow control device 206 may engage with shroud 204 and tubing 210 to prevent fluids circulating in screen annulus 212 from flowing between electronic inflow control device 206 and tubing 210 or shroud 204. For example, electronic inflow control device 206 may engage with the inner surface of shroud 204 to form a fluid and pressure tight seal and may engage with the outer surface of tubing 210 to form a fluid and pressure tight seal. Fluids circulating in wellbore 114 may enter downhole assembly 200 by flowing through screen 202 into screen annulus 212. From screen annulus 212, fluids may flow through electronic inflow control device 206 and into tubing 210 through opening 216 formed in the sidewall of tubing 210. Similarly, fluids circulating in production string 103 may enter wellbore 114 by flowing through opening 216 formed in the sidewall of tubing 210 and through the electronic inflow control device 206. From the electronic inflow control device 206, fluids may flow into screen annulus 212. From screen annulus 212, fluids may flow through screen 202, and into wellbore 114.

Electronic inflow control device 206 may be utilized to regulate fluid flow into downhole assembly 200 from wellbore 114 or out of downhole assembly 200 into wellbore 114. For example, the rate of fluid flow through electronic inflow control device 206 may be regulated by adjusting the flow resistance provided by electronic inflow control device 206. Electronic inflow control device 206 may be in communication with a signaling device 218, such as telemetry system, that is displaced from electronic inflow control device 206 and that signals electronic inflow control device 206 to increase or decrease the flow resistance provided by electronic inflow control device 206. For example, the signaling device 218 may be located at a well site (e.g., well site 106 as illustrated in FIG. 1), within wellbore 114 at a location different from the location of electronic inflow control device 206, or within a lateral wellbore. An increase in the flow resistance provided by electronic inflow control device 206 may result in a corresponding decrease in the rate of fluid flow through electronic inflow control device 206, while a decrease in the flow resistance provided by electronic inflow control device 206 may result in a corresponding increase in the rate of fluid flow through electronic inflow control device 206. The signaling device 218 may be used to induce the adjustment of the flow resistance for any desired reason. For example, the signaling device 218 may be used to induce the adjustment of the flow resistance if water is detected within the electronic inflow control device 206 or within a second electronic inflow control device 206. Alternatively, or in addition to, the electronic inflow control device 206 may function as a passive inflow control device and autonomously adjust the flow resistance if water is detected with the electronic inflow control device 206.

Although downhole assembly 200 is illustrated as comprising a single electronic inflow control device 206, multiple electronic inflow control devices 206 may be utilized to regulate fluid flow into downhole assembly 200 from a wellbore 114. For example, electronic inflow control device 206 may be located at multiple locations within the wellbore 114 in order to regulate fluid flow into the downhole assembly 200 or any other completions equipment out of various parts of wellbore 114. Additionally, electronic inflow control devices 206 may be used in conjunction with non-electronic inflow control devices, e.g., passive inflow control devices, which may not possess electronics and/or moving parts. Any number and any combination of electronic inflow control devices 206 and non-electronic inflow control devices may be used as desired.

Figure 3:
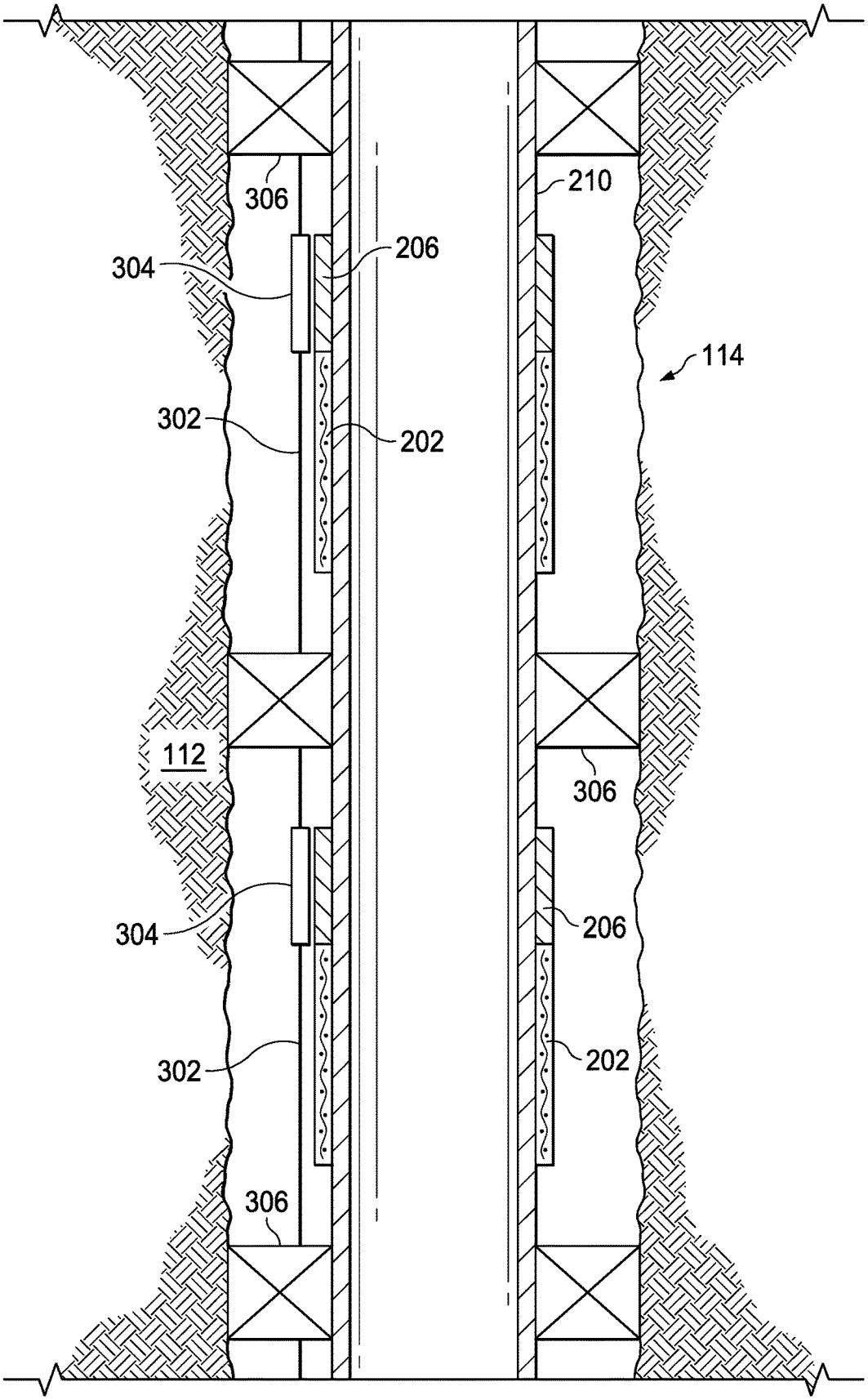
FIG. 3 is a cross-sectional view of an electronic inflow control device coupled to an electric control line in a wellbore.
Figure 4:
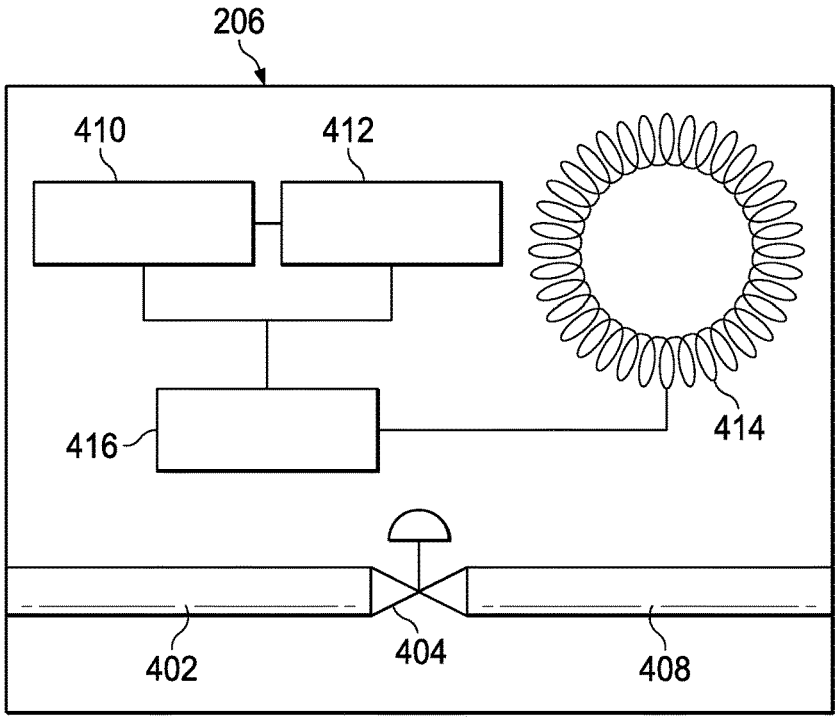
FIG. 4 is a schematic of an electronic inflow control device including a flow regulator and a secondary winding.

FIG. 3 is a cross-sectional view of multiple electronic inflow control devices 206 inductively coupled to an electric control line 302. As illustrated in FIG. 3, electronic inflow control devices 206 are disposed within isolated zones of a wellbore 114 between packers 306. The electronic inflow control devices 206 may be coupled to tubing 210 as described above and may be positioned adjacent to an electric control line 302. Production fluids circulating in wellbore 114 may flow through screen 202, into screen annulus 212 (as illustrated in FIG. 2), through electronic inflow control device 206, and into tubing 210. If water is a fluid circulating in wellbore 114, water may be produced instead of or in addition to hydrocarbons. In order to reduce water production, electronic inflow control device 206 may increase fluid resistance and thusly reduce fluid inflow through electronic inflow control device 206 and, consequently, tubing 210. Increasing fluid resistance in electronic inflow control device may be performed by the actuation of a flow regulator (e.g., flow regulator 404 as illustrated in FIG. 4). Actuation of the flow regulator may require electrical power. The electrical power to actuate the flow regulator may be provided to the electronic inflow control device 206 by inductively coupling a secondary winding (e.g., secondary winding 414 as illustrated in FIG. 4) within the electronic inflow control device 206 to a primary winding 304 of an electric control line 302. As electrical current flows through the electric control line 302 and the primary winding 304, the magnetic field generated by primary winding 304 may induce a current in the secondary winding within the electronic inflow control device 206, and the induced current in the secondary winding may be used to charge a power storage unit (e.g., power storage unit 416 as illustrated in FIG. 4) within the electronic inflow control device 206 or to power the electronic components of electronic inflow control device 206. As such, electric power sufficient to operate electronic inflow control device 206 may be transferred to electronic inflow control device 206 from electric control line 302 in a contactless manner.

Additionally, electric control line 302 may be used for telemetric communication with and/or control of electronic inflow control device 206. For example, by controlling the frequency or amplitude of the signal on the electric control line 302, a communication may be provided to the electronic inflow control device 206. Analogously, the electronic inflow control device may provide a communication to the surface via the electric control line 302 by modulating the electric load of the electronic inflow control device 206. Specifically, the electric load of the electronic inflow control device 206 may be modulated, for example, through the use of a resistor in parallel (or any other method of modulating the electric load), and this modulation of the electric load may induce a response in the electric control line 302 which may be measured.

In some examples, an operator at the surface may modulate the frequency or amplitude of the signal on the electric control line 302. This modulation may be detected by the electronic inflow control device 206. The electronic inflow control device 206 may be programmed to respond to this specific modulation. This specific modulation may correspond to a request for an output of a specific type of data from the electronic inflow control device 206. The requested output may correspond to a request for specific set of raw data or to an analysis of a set of data (slopes, trends, standard deviation, etc.). For example, the requested output may correspond to a check of the status of the electronic inflow control device 206, a request for a measurement of the current pressure in the wellbore 114 at the location of the electronic inflow control device 206, a request for an analysis of any trends in the pressure in the wellbore 114 at the location of the electronic inflow control device 206, a request for a measurement of the current temperature in the wellbore 114 at the location of the electronic inflow control device 206, a request for an analysis of any trends in the temperature in the wellbore 114 at the location of the electronic inflow control device 206, a request for a measurement of the flow rate through the electronic inflow control device 206, a request for a measurement or analysis of the fluid properties (e.g., fluid resistivity, fluid density, fluid viscosity, etc.) of a fluid or fluids flowing through the electronic inflow control device 206, a request for the status of the flow regulator 404 (e.g., is the flow regulator open, closed, partially open, partially closed, etc.). In response to these output requests, the electronic inflow control device 206 may modulate its electric load (e.g., by using a resistor in parallel) to induce a response in the electric control line 302 which may be measured. This measurement may then be used in any suitable manner by an operator at the surface. For example, the operator may adjust the operation of the electronic inflow control device 302 or one or more other electronic inflow control devices 302. In some examples, the modulation of amplitude and/or frequency of the electric control line 302 may be used to provide a communication to multiple electronic inflow control devices 302. In some examples, the modulation of the electric load of an electronic inflow control device 206, may induce a response in the electric control line 302 which may be measured by another electronic inflow control device 206, and the other electronic inflow control device 206 may alter its operation in response or may modulate its own electric load in response.

In some examples, the electronic inflow control device 206 may be programmed to autonomously modulate its electric load to induce a response in the electric control line 302. For example, the electronic inflow control device 206 may be programmed to modulate its electric load and to induce a response in the electric control line 302 at any time in which its flow regulator 404 has been adjusted. As another example, the electronic inflow control device 206 may be programmed to modulate its electric load and to induce a response in the electric control line 302 at any time in which the flow rate through the electronic inflow control device 302 changes.

Electric control line 302 may be any sufficient electric control line for use in a wellbore. Electric control line 302 may be used to supply power to downhole tools or any type of wellbore equipment. For example, the electric control line 302 may be an electric control line used to power distributed temperature sensing equipment, pressure sensing equipment, submersible pumps, downhole gauges, downhole control systems, remote monitoring equipment, and the like. Electric control line 302 may be disposed within wellbore 114 in a manner sufficient to provide electrical power to the downhole equipment connected to it, and also in a manner sufficient to inductively couple electric control line 302 to electronic inflow control device 206. Without limitation by theory, the primary winding 304 of the electric control line 302 may be positioned close enough to the secondary winding (e.g., secondary winding 414 as illustrated in FIG. 4) of the electronic inflow control device 206 such that the magnetic field generated by the primary winding 304 is able to generate a sufficient voltage for operation of the electronic components of the electronic inflow control device 206. The amount of voltage necessary may be a factor of the power requirements of the electronic inflow control device 206, the presence of a power storage unit in the electronic inflow control device 206, and other reasons. For example, the primary winding 304 of the electric control line 302 may be positioned proximate to electronic inflow control device 206 but within ten feet of electronic inflow control device 206. As a further example, electric control line 302 may be positioned within ten feet, nine feet, eight feet, seven feet, six feet, five feet, four feet, three feet, two feet, or one foot of the electronic inflow control device 206.

Electric control line 302 may comprise primary winding 304. Primary winding 304 comprises a wound coil of wire within the electric control line 302. As used herein, "primary" designates a winding through which electric current is introduced via the electric control line 302. "Primary" does not designate any orientation or sequence, and is merely intended to differentiate between the winding(s) of the electric control line 302 and any winding(s) within the electronic inflow control device 206. Furthermore, it is to be understood that the mere use of the term "primary" does not require that there be any "second," and the mere use of the term "secondary" does not require that there be any "third," etc. The wire within the electric control line 302 may be wound into a coil as necessary to generate a sufficient magnetic field for generating a voltage within a secondary winding. In some examples, only the portion of electric control line 302 adjacent to the electronic inflow control device 206 may comprise a primary winding 304. In other examples, the electric control line 302 may comprise a primary winding 304 that is not adjacent to an electronic inflow control device 206. In still other examples, a majority of the electric control line 302 may be wound into a primary winding 304. In still further examples, the entirety of the electric control line 302 may comprise a primary winding 304. In some examples, the coiled wire of the primary winding 304 may be substantially straight. In other examples, the coiled wire of the primary winding 304 may be bent, curved, or coiled as desired. In some examples, the resonance frequency of the primary winding 304 may be the same as the resonance frequency of the secondary winding (e.g., secondary winding 414 as illustrated in FIG. 4) of the electronic inflow control device 206.

FIG. 4 is a schematic of an electronic inflow control device 206 including a flow regulator 404. Electronic inflow control device 206 may include flow regulator 404, which may be adjustable to provide varying degrees of flow resistance through electronic inflow control device 206. Electronic inflow control device 206 may also include sensor 410 operable to receive signals from a signaling device (e.g., signaling device 218 illustrated in FIG. 2) at a location displaced from the location of electronic inflow control device 206. For example, sensor 410 may be operable to receive signals from a signaling device, such as a telemetry system, located at well site 106 (as illustrated in FIG. 1), or a signaling device located within wellbore 114 (as illustrated in FIGS. 1-3) at a location different from the location of electronic inflow control device 206 or within a lateral wellbore. Electronic inflow control device 206 may further include controller 412 communicatively coupled to sensor 410 and operable to control adjustment of the flow resistance provided by flow regulator 404 in response to signals received by sensor 410.

Fluid circulating in wellbore 114 (as illustrated in FIGS. 1-3) may flow into electronic inflow control device 206 via inlet 402 and may flow through flow regulator 404 and then exit electronic inflow control device 206 via outlet 408. Flow regulator 404 may include a flow restricting device adjustable to provide varying degrees of flow resistance. For example, flow regulator 404 may include a valve controlled by an actuator to increase or decrease the flow resistance. The flow resistance provided by the valve may increase as the valve is moved from a fully or partially open position towards a closed position and may decrease as the valve is moved from a closed or partially open position towards a fully open position. As another example, flow regulator 404 may include an orifice with an insert controlled by an actuator that may be moved axially into the orifice to increase or decrease the flow resistance. The flow resistance provided by the insert may increase as the insert extends into the orifice and may decrease as the insert is withdrawn from the orifice. As yet another example, flow regulator 404 may include an adjustable vortex diode. The flow resistance provided by the diode may be increased or decreased by changing the angle at which fluid flows into the diode. The flow resistance provided by the diode may be at a maximum when the fluid enters the diode tangentially to the diode wall and at a minimum when the fluid enters the diode radially.

Sensor 410 may receive signals from a signaling device (e.g., signaling device 218 illustrated in FIG. 2) at a location displaced from the location of electronic inflow control device 206. For example, sensor 410 may be operable to receive signals from a signaling device, such as a telemetry system, located at well site 106 (as illustrated in FIG. 1), a location within wellbore 114 (as illustrated in FIGS. 1-3) different from the location of electronic inflow control device 206, or a lateral wellbore. The signals received by sensor 410 may include commands to adjust the flow resistance provided by electronic inflow control device 206. Signals may be transmitted to sensor 410 using variations in the pressure or flow rate of fluid flowing through electronic inflow control device 206, which may be detected by sensor 410. For example, the rate of fluid flow through electronic inflow control device 206 may be dependent upon the rate of fluid flow in wellbore 114 (as illustrated in FIGS. 1-3), which may be controlled by an operator at well site 106 (as illustrated in FIG. 1). The operator may control the rate of fluid flow in wellbore 114 (as illustrated in FIGS. 1-3) by, for example, controlling a choke, the bypass around a choke, or the backpressure at well site 106 (as illustrated in FIG. 1) to generate a plurality of pressure profiles or flow rate profiles, each of which may correspond to a command to adjust the flow resistance provided by electronic inflow control device 206. Sensor 410 may be operable to detect variations in the pressure and flow rate of fluid flowing through electronic inflow control device 206 by, for example, measuring the rate of rotation or vibration of an accelerometer, hydrophone, or any other device operable to detect variations in the pressure or flow rate of fluid flowing through electronic inflow control device 206.

In response to the signals received by sensor 410, controller 412 may actuate flow regulator 404 to perform the particular command corresponding to the signal received by sensor 410. For example, a first pressure or flow rate profile may correspond to a command to increase the flow resistance provided by flow regulator 404 by a particular amount. When sensor 410 detects the first pressure or flow rate profile, controller 412 may actuate flow regulator 404 to increase the flow resistance provided by flow regulator 404 by the specified amount. As another example, a second pressure or flow rate profile may correspond to a command to decrease the flow resistance provided by flow regulator 404 by a particular amount. When sensor 410 detects the second pressure or flow rate profile, controller 412 may actuate flow regulator 404 to decrease the flow resistance provided by flow regulator 404 by the specified amount. Similarly, particular pressure or flow rate profiles may correspond to commands to adjust the flow resistance provided by flow regulator 404 to a particular value, adjust the flow resistance provided by flow regulator 404 to a minimum (e.g., fully open flow regulator 404), adjust the flow resistance provided by flow regulator 404 to a maximum (e.g., fully close flow regulator 404), or perform any command after a specified time delay. When sensor 410 detects one of these pressure or flow rate profiles, controller 412 may actuate flow regulator 404 to adjust the flow resistance provided by flow regulator 404 according to the command corresponding to the particular pressure or flow rate profile detected by sensor 410.

Additionally, signals may be transmitted from electronic inflow control device 206 to another location, such as well site 106 (as illustrated in FIGS. 1-3) or other electronic inflow control devices within well system 100 (as illustrated in FIG. 1) using variations in the pressure or flow rate of fluid flowing through electronic inflow control device 206, which may be detected by a sensor located at well site 106 (as illustrated in FIG. 1) or associated with an electronic inflow control device within well system 100. For example, controller 412 may actuate flow regulator 404 to increase or decrease the rate of fluid flow through electronic inflow control device 206 to generate a plurality of pressure or flow rate profiles, each of which may correspond to a particular message or signal to be transmitted to well site 106 or another electronic inflow control device 206. Messages or signals transmitted to well site 106 or another electronic inflow control device 206 may include information relating to the status and/or operability of electronic inflow control device 206, measurements taken by sensor 410, the flow resistance provided by flow regulator 404, verification that signals transmitted to electronic inflow control device 206 from well site 106 and/or another electronic inflow control device 206 were received, commands to adjust the pressure and/or flow rate at well site 106 and/or another electronic inflow control device 206, and combinations thereof.

Flow regulator 404, sensor 410, and controller 412 may be powered by current from secondary winding 414. As discussed above, a voltage may be induced in secondary winding 414 through the inductive coupling of secondary winding 414 with the primary winding 304 (as illustrated in FIG. 3) of an electric control line 302 (as illustrated in FIG. 3). Secondary winding 414 comprises a wound coil of wire within the electronic inflow control device 206. As used herein, "secondary" designates a winding through which electric current is induced via the magnetic field produced by the primary winding 304 of an electric control line 302. "Secondary" does not designate any orientation or sequence, and is merely intended to differentiate between the winding(s) of the electric control line and any winding(s) within the electronic inflow control device 206. Furthermore, it is to be understood that the mere use of the term "secondary" does not require that there be any "first," "third," etc. In examples, the secondary winding 414 may be within a range of the primary winding 304 (as illustrated in FIG. 3) such that a sufficient amount of voltage is induced within the secondary winding 414 to provide an electric current necessary to operate the electronic components (e.g., flow regulator 404, sensor 410, and/or control 412) of the electronic inflow control device 206. As such, the secondary winding 414 may allow for the operation of the electronic components of the electronic inflow control device 206 with electrical power induced within the electronic inflow control device 206 in a contactless manner, such that the electronic inflow control device 206 does not require a generator or other independent source or electrical power nor does it require a direct connection with an exterior source of electrical current (e.g., electric control line 302 as illustrated in FIG. 3). In some examples, the coiled wire of the secondary winding 414 may be substantially straight. In other examples, the coiled wire of the secondary winding 414 may be bent, curved, or coiled as desired. In some examples, the resonance frequency of the secondary winding 414 may be the same as the resonance frequency of the primary winding (e.g., primary winding 304 as illustrated in FIG. 3) of the electric control line 302.

As illustrated in FIG. 4, secondary winding 414 may be optionally coupled to a power storage unit 416. Power storage unit 416 may be used to store electrical power generated by secondary winding 414 and supply electrical power to components of the electronic inflow control device 206, including receiver 410, controller 412, and flow regulator 404. Power storage unit 416 may comprise a battery or any such unit sufficient for storing voltage induced in secondary winding 414. Power storage unit 416 may allow for operation of the electronic components of electronic inflow control device 206 when voltage is not being induced in secondary winding 414. Further, power storage unit 416 may allow for the storage of voltage induced in secondary winding 414 when the electronic components of the electronic inflow control device 206 are not being operated. In alternative embodiments, electronic inflow control device 206 does not comprise a power storage unit 416, and the secondary winding 414 may be connected directly to any electronic components of electronic inflow control device 206 as desired.

In some examples, the electronic components (e.g., flow regulator 404, sensor 410, and/or control 412) of electronic inflow control device 206 may use reduced amounts of power. "Reduced amounts of power" as defined herein, refers to an amount of power consumption required for operation of an electronic component that is less than 100 mW. In examples, the electronic components of the electronic inflow control device 206 may individually or in combination require less than 100 mW to operate. For example, the flow regulator 404 may require less than 100 mW, less than 90 mW, less than 80 mW, less than 70 mW, less than 60 mW, or less than 50 mW to operate. As another example, the sensor 410, controller 412, and flow regulator 404 may in combination require less than 100 mW, less than 90 mW, less than 80 mW, less than 70 mW, less than 60 mW, or less than 50 mW to operate.

Figure 5:
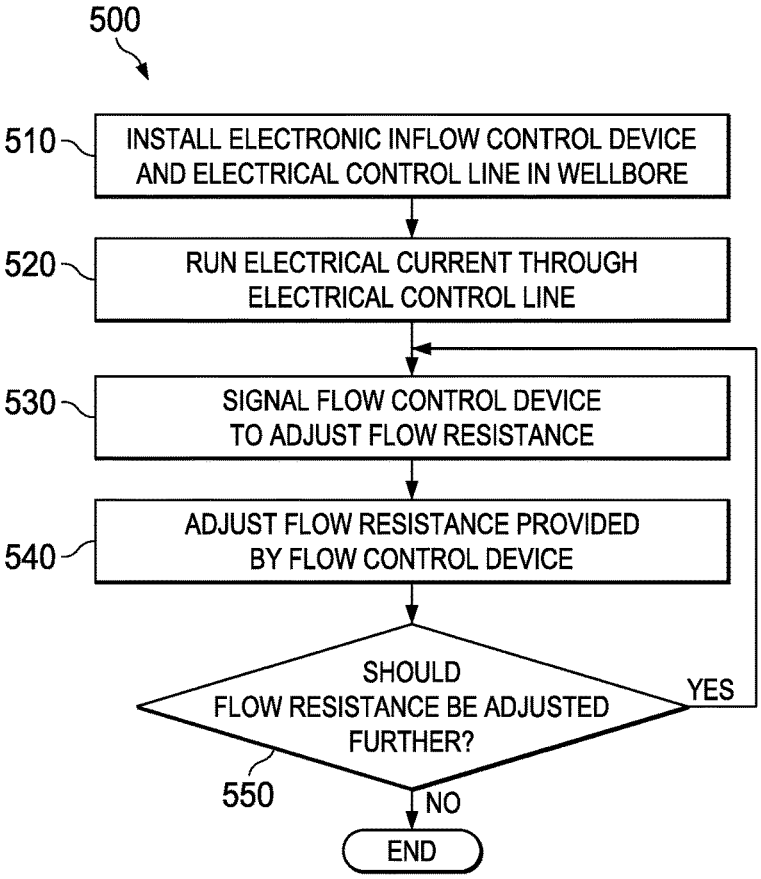
FIG. 5 is a flow-chart of a method of regulating fluid flow into or out of a wellbore.

FIG. 5 illustrates a method of regulating fluid flow into or out of a wellbore. Method 500 may begin at step 510 where an electronic inflow control device (e.g., electronic inflow control device 206 as illustrated in FIGS. 2-4) and an electric control line (e.g., electric control line 302 as illustrated in FIG. 3) are introduced and installed within a wellbore (e.g., wellbore 114 as illustrated in FIGS. 1-3). After installation, at step 520, electric current may be run through the electric control line to either charge a power storage unit (e.g., power storage unit 416 as illustrated in FIG. 4) and/or to provide power to operate the electronic components (e.g., flow regulator 404, sensor 410, and/or control 412) of electronic inflow control device 206.

At step 530, a signal may be received by the electronic inflow control device including a command to adjust the flow resistance provided by the electronic inflow control device. As discussed above with respect to FIG. 4, an electronic inflow control device may include a sensor (e.g., sensor 410) operable to receive signals from a signaling device (e.g., signaling device 218 illustrated in FIG. 2), such as a telemetry system, that is displaced from the electronic inflow control device. For example, the signaling device may be located at a well site, a location in the wellbore different from the location of the electronic inflow control device, or a location within a lateral wellbore. The signals received by the electronic inflow control device may include commands to adjust the flow resistance provided by the electronic inflow control device. Signals may be transmitted to the sensor using variations in the pressure or flow rate of fluid flowing through the electronic inflow control device, which may be detected by the sensor. As explained above in conjunction with FIG. 4, the rate of fluid flow through the electronic inflow control device may be dependent upon the rate of fluid flow in the wellbore, which may be controlled by an operator at the well site. The operator may control the rate of fluid flow in the wellbore to generate a plurality of pressure profiles or flow rate profiles, each of which may correspond to a command to adjust the flow resistance provided by the electronic inflow control device.

At step 540, the flow resistance provided by the electronic inflow control device may be adjusted. As discussed above in conjunction with FIG. 4, the electronic inflow control device may include a flow regulator (e.g., flow regulator 404), which may be adjustable to provide varying degrees of flow resistance, and a controller (e.g., controller 412), which may be communicatively coupled to the sensor and operable to control adjustment of the flow resistance provided by the flow regulator in response to signals received by the sensor. For example, when the sensor detects a pressure or flow rate profile corresponding to a command to increase the flow resistance provided by the flow regulator by a particular amount, the controller may actuate the flow regulator to increase the flow resistance provided by the flow regulator by the specified amount. As another example, when the sensor detects a pressure or flow rate profile corresponding to a command to decrease the flow resistance provided by the flow regulator by a particular amount, the controller may actuate the flow regulator to decrease the flow resistance provided by the flow regulator by the specified amount. Similarly, when the sensor detects a pressure or flow rate profile corresponding to a command to adjust the flow resistance provided by the flow regulator to a particular value, adjust the flow resistance provided by the flow regulator to a minimum (e.g., fully open the flow regulator), adjust the flow resistance provided by the flow regulator to a maximum (e.g., fully close the flow regulator), or perform any commands after a specified time delay, the controller may actuate the flow regulator to adjust the flow resistance provided by the flow regulator according to the command corresponding to the particular pressure or flow rate profile detected by the sensor.

At step 550, a determination may be made regarding whether to further adjust the flow resistance provided by the electronic inflow control device. If it is determined that the flow resistance provided by the electronic inflow control device should be further adjusted, the method may return to step 530. If it is determined that the flow resistance provided by the electronic inflow control device should not be further adjusted, method 500 may end.

Modifications, additions, or omissions may be made to method 500 without departing from the scope of the present disclosure. For example, the order of the steps may be performed in a different manner than that described, and some steps may be performed at the same time. Additionally, each individual step may include additional steps without departing from the scope of the present disclosure.

A method includes electrically charging a power storage unit in a wellbore by inductive coupling. The method further includes actuating a flow regulator with the stored electricity from the power storage unit.

Well systems in subterranean formations are provided. An example of a well system in a subterranean formation comprises an electric control line which may comprise at least one primary winding, and an electronic inflow control device which may comprises a secondary winding inductively coupled to the primary winding, a flow regulator in fluidic communication with an inlet of the electronic inflow control device and adjustable to provide a flow resistance to a fluid flowing through the electronic inflow control device, and a controller configured to actuate the flow regulator to change the flow resistance through the electronic inflow control device. The well system may further comprise a sensor configured to detect a variation in a pressure or a flow rate of the fluid flowing through the electronic inflow control device, the variation in the pressure or flow rate corresponding to a signal received by the electronic inflow control device from a signaling device at a location displaced from the electronic inflow control device. The well system may further comprise a power storage unit coupled to the secondary winding. The electronic inflow control device may not comprise a generator. The electronic inflow control device may be disposed in a wellbore within ten feet of the primary winding of the electric control line. The flow regulator may be operable using less than 100 mW of electricity. The electric control line may comprise a plurality of primary windings, wherein each of the plurality of primary windings may be inductively coupled to each of a secondary winding of a plurality of electronic inflow control devices. The well system may further comprise a passive inflow control device. The secondary winding may be coupled to the flow regulator and the controller. The power storage unit may be coupled to the flow regulator and the controller. The amplitude or frequency of the electric control line may be modulated as desired. The electric load of the electronic inflow control device may be modulated as desired. The electronic inflow control device may be coupled to a tubing and the actuation of the flow regulator within the electronic control device may reduce the flow of water into the tubing.

Electronic inflow control devices are provided. An example of an electronic inflow control device comprises a flow regulator in fluidic communication with an inlet of the electronic inflow control device and adjustable to provide a flow resistance to a fluid flowing through the electronic inflow control device; a controller communicatively configured to actuate the flow regulator to change the flow resistance; and a secondary winding. The electronic inflow control device may further comprise a sensor configured to detect a variation in a pressure or a flow rate of the fluid flowing through the electronic inflow control device, the variation in the pressure or flow rate corresponding to a signal received by the electronic inflow control device from a signaling device at a location displaced from the electronic inflow control device. The electronic inflow control device may further comprise a power storage unit coupled to the secondary winding. The electronic inflow control device may not comprise a generator. The electronic inflow control device may be disposed in a wellbore within ten feet of the primary winding of the electric control line. The flow regulator may be operable using less than 100 mW of electricity. The electric control line may comprise a plurality of primary windings, wherein each of the plurality of primary windings may be inductively coupled to each of a secondary winding of a plurality of electronic inflow control devices. The electronic inflow control device may further comprise a passive inflow control device. The secondary winding may be coupled to the flow regulator and the controller. The power storage unit may be coupled to the flow regulator and the controller. The amplitude or frequency of the electric control line may be modulated as desired. The electric load of the electronic inflow control device may be modulated as desired. The electronic inflow control device may be coupled to a tubing and the actuation of the flow regulator within the electronic control device may reduce the flow of water into the tubing.

Methods of adjusting flow resistance in an electronic inflow control device within a wellbore are provided. An example method comprises inductively coupling a primary winding of an electric control line with a secondary winding within the electronic inflow control device; running electric current through the primary winding, wherein the running electric current through the primary winding induces the generation of electricity in the secondary winding; and actuating a flow regulator within the electronic inflow control device. The electronic inflow control device may further comprise a sensor configured to detect a variation in a pressure or a flow rate of the fluid flowing through the electronic inflow control device, the variation in the pressure or flow rate corresponding to a signal received by the electronic inflow control device from a signaling device at a location displaced from the electronic inflow control device. The electronic inflow control device may further comprise a power storage unit coupled to the secondary winding. The electronic inflow control device may not comprise a generator. The electronic inflow control device may be disposed in a wellbore within ten feet of the primary winding of the electric control line. The flow regulator may be operable using less than 100 mW of electricity. The electric control line may comprise a plurality of primary windings, wherein each of the plurality of primary windings may be inductively coupled to each of a secondary winding of a plurality of electronic inflow control devices. The electronic inflow control device may further comprise a passive inflow control device. The secondary winding may be coupled to the flow regulator and the controller. The power storage unit may be coupled to the flow regulator and the controller. The amplitude or frequency of the electric control line may be modulated as desired. The electric load of the electronic inflow control device may be modulated as desired. The electronic inflow control device may be coupled to a tubing and the actuation of the flow regulator within the electronic control device may reduce the flow of water into the tubing. The electronic inflow control device may further comprise a controller coupled to the flow regulator, wherein the controller may induce actuation of the flow regulator, and wherein the inducement of the actuation of the flow regulator by the controller may use less than 100 mW of electricity.

Therefore, the disclosed systems and methods are well adapted to attain the ends and advantages mentioned, as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative embodiments disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A well system in a subterranean formation, comprising:

an electric control line tethered to the surface and disposed in a wellbore within the subterranean formation, the electric control line comprising:

at least one primary winding; and an electronic inflow control device, wherein the electronic inflow control device comprises:

a secondary winding inductively coupled to the primary winding;

a flow regulator in fluidic communication with an inlet of the electronic inflow control device and adjustable to provide varying degrees of flow resistance to a fluid flowing through the electronic inflow control device, a controller configured to actuate the flow regulator to adjust the varying degrees of flow resistance through the electronic inflow control device, and a sensor configured to detect a variation in a pressure or a flow rate of the fluid flowing through the electronic inflow control device, the variation in the pressure or flow rate corresponding to a signal received by the electronic inflow control device from a signaling device at a location displaced from the electronic inflow control device.

2. The well system of claim 1 further comprising a power storage unit coupled to the secondary winding.

3. The well system of claim 1, wherein the electronic inflow control device does not comprise a generator.

4. The well system of claim 1, wherein the electronic inflow control device is disposed in a wellbore within ten feet of the primary winding of the electric control line.

5. The well system of claim 1, wherein the flow regulator is operable using less than 100 mW of electricity.

6. The well system of claim 1, wherein the electric control line comprises a plurality of primary windings and wherein each of the plurality of primary windings is inductively coupled to each of a secondary winding of a plurality of electronic inflow control devices.

7. The well system of claim 1, further comprising a passive inflow control device.

8. An electronic inflow control device, comprising:

a flow regulator in fluidic communication with an inlet of the electronic inflow control device and adjustable to provide varying degrees of flow resistance to a fluid flowing through the electronic inflow control device;

a controller communicatively configured to actuate the flow regulator to adjust the varying degrees of flow resistance;

a secondary winding inductively coupled to a primary winding in an electric control line positioned proximate the electronic inflow control device; and a sensor configured to detect a variation in a pressure or a flow rate of the fluid flowing through the electronic inflow control device, the variation in the pressure or flow rate corresponding to a signal received by the electronic inflow control device from a signaling device at a location displaced from the electronic inflow control device.

9. The electronic inflow control device of claim 8, wherein the secondary winding is coupled to the flow regulator and the controller.

10. The electronic inflow control device of claim 8, wherein the secondary winding is coupled to a power storage unit.

11. The electronic inflow control device of claim 10, wherein the power storage unit is coupled to the flow regulator and the controller.

12. A method of adjusting flow resistance in an electronic inflow control device within a wellbore, the method comprising:

inductively coupling a primary winding of an electric control line with a secondary winding within the electronic inflow control device; wherein the electric control line is tethered to the surface and disposed in the wellbore;

running electric current through the primary winding, wherein the running electric current through the primary winding induces the generation of electricity in the secondary winding;

actuating a flow regulator within the electronic inflow control device to provide varying degrees of flow resistance to a fluid flowing through the electronic inflow control device;

controlling the varying degrees of flow resistance with a controller communicatively configured to actuate the flow regulator; and detecting a variation in a pressure or a flow rate of the fluid flowing through the electronic inflow control device with a sensor, the variation in the pressure or flow rate corresponding to a signal received by the electronic inflow control device from a signaling device at a location displaced from the electronic inflow control device.

13. The method of claim 12, wherein the electronic inflow control device further comprises a power storage unit and wherein the power storage unit stores at least a portion of the electricity generated in the secondary winding.

14. The method of claim 12, further comprising modulating the amplitude or frequency of the electric control line.

15. The method of claim 12, further comprising modulating the electric load of the electronic inflow control device.

16. The method of claim 12, wherein the electronic inflow control device is disposed in the wellbore within ten feet of the primary winding of the electric control line.

17. The method of claim 12, wherein the flow regulator is operable using less than 100 mW of electricity.

18. The method of claim 12, wherein the electronic inflow control device is coupled to a tubing and wherein the actuation of the flow regulator within the electronic control device reduces the flow of water into the tubing.

19. The method of claim 12, wherein the inducement of the actuation of the flow regulator by the controller uses less than 100 mW of electricity.

* * * * *